US005681030A

United States Patent [19]

Nall

[11] Patent Number: 5,681,030

[45] Date of Patent: Oct. 28, 1997

[54] DEVICE FOR PULLING FENCE POSTS

[76] Inventor: Timothy Scott Nall, 3755 S. Tacoma, Tulsa, Okla. 74107

[21] Appl. No.: 443,681

[22] Filed: May 18, 1995

[51] Int. Cl.[6] ..... E21B 19/00

[52] U.S. Cl. ..... 254/30; 254/131; 254/132

[58] Field of Search ..... 29/29 R, 30, 31, 29/131, 132, 94

[56] References Cited

U.S. PATENT DOCUMENTS

| | | | |
|---|---|---|---|
| 1,075,883 | 10/1913 | Warren . | |
| 1,452,205 | 4/1923 | Madsen | 254/31 |
| 1,916,463 | 7/1933 | Carrel | 254/132 |
| 2,582,284 | 1/1952 | Sarosdy | 254/132 |
| 2,926,890 | 3/1960 | Majors . | |
| 3,103,343 | 9/1963 | Benchley | 254/132 |
| 3,147,718 | 9/1964 | Steinberg | 254/132 |
| 3,288,437 | 11/1966 | Pederson | 254/132 |
| 3,779,516 | 12/1973 | King . | |
| 3,991,976 | 11/1976 | Skinner . | |
| 4,135,700 | 1/1979 | Arzoian | 254/132 |
| 4,750,711 | 6/1988 | Landry . | |
| 5,022,632 | 6/1991 | Beideck . | |
| 5,052,659 | 10/1991 | Bates . | |

*Primary Examiner*—Robert C. Watson
*Attorney, Agent, or Firm*—Molly D. McKay

[57] ABSTRACT

A pry bar device for pulling T-type fence posts out of the ground. The device consists of an upward extending rod which may be gripped by the user. A lower end of the rod extends through an opening in a channel member and forms a U-shaped loop which welds to the bottom surface of the channel member near a front end of the channel member. The channel member has a rear end which extends beyond the rod and the front end is provided with grasping means for removably engaging the posts. The grasping means consist of two arms each adjacent to a corresponding slot. The arms and slots are parallel with a longitudinal axis of the channel member, and a central tongue separates the two slots. An upward extending tab is provided terminally on each arm and said tongue terminates rearward of said front end.

8 Claims, 2 Drawing Sheets

DEVICE FOR PULLING FENCE POSTS

BACKGROUND OF THE INVENTION

1. Field of the Invention

The present invention relates to a hand carried device which can be positioned at a side of a metal T-post and used to pull the post out of the ground.

2. Description of the Related Art

When trees are newly planted, it is advisable to stake them upright for at least the first year after they are planted. Generally, two or more metal T-type fence posts are driven into the ground around the tree in order that the tree can be tied to the devices. Trees which are thus supported are less likely to be either completely or partially blown over by the wind and less likely to incur root damage as the tree is twisted by the wind.

After the trees have grown for about a year in their new location, they are normally sufficiently established so that they no longer require support from the posts to which they are staked. At this time, the fastening devices are removed from the posts and the trees. The posts are then usually removed from the ground so they may be reused elsewhere.

One of the obstacles faced in trying to remove the posts from the ground is that the posts are fairly well fixed in the ground and are extremely difficult to remove therefrom by hand, i.e., without the aid of some type of motorized vehicle, such as a truck, to assist in the removal. Posts are particularly difficult to remove from the ground when the soil is hard and dry.

Another obstacle faced in removing posts from the ground is that the trees are often planted on sloped surfaces, such as on banks on a road right-of-way, which are inaccessible by motorized vehicles. Still another obstacle in removing posts from the ground is that the trees are often planted in close proximity to each other, thus limiting the space available for carrying a tool to the location of the post which is to be removed and also limiting the space available for using the tool to remove the post.

The present invention addresses these obstacles by providing a device for pulling T-type fence posts. It is an object of the present invention to provide a hand-held easily transportable device for removing posts from the ground.

A further object of the invention is to provide a device for pulling a post from the ground which can quickly be removably attached on either side of a T-type post.

Still a further object of the invention is to provide an inexpensive one-piece device for pulling posts, having no moving parts to break.

Another object of the present invention is to provide a device which can be employed in all types of soils and all types of weather to safely and quickly remove posts from the ground.

SUMMARY OF THE INVENTION

The present invention is a device for removing T-type fence posts from the surface of the ground. The device is provided with a rod which extends through an opening provided in a rear end of a channel iron member. The rod located below the channel iron member is curved in a loop of approximately 180 degrees so that a rearward end of the loop attaches to the channel iron member at the opening and a forward end of the loop attaches to an underside of the channel iron member near a front end of the channel iron member. The rod has an upper rod end which extends upward from the rearward end of the loop before terminating at a terminal portion. The terminal portion is bent slightly toward the front end of the channel iron member so that it forms an angle of approximately 170 degrees with the upper rod end.

An upper end of a support bar secures to the upper rod end and an opposite lower end of the support bar secures to an upper side of the channel iron member in order to reinforce the upper rod end.

The front end of the channel iron member is provided with first and second slots. Each slot is parallel with a longitudinal axis of the channel iron member and the slots are separated from each other by a tongue which terminates rearward of the front end. The front end is provided with a first and a second arm, each of which is parallel to the longitudinal axis of the channel iron member and located so that the first slot is between the tongue and the first arm and so that the second slot is between the tongue and the second arm.

Each of the arms is provided terminally with an upward extending tab. The tabs are capable of removably engaging ears provided on a flat back bar of the T-type fence posts, and the slots are capable of removably receiving a half of the flat back bar. A side of the flat back bar opposite the ears is provided with a lower bar which attaches to the flat back bar along the longitudinal axis of the T-type fence post. The lower bar is capable of being removably received between the arms so that the lower bar lies adjacent the tongue.

A stand is provided on a lower portion of the loop, preferably slightly closer to the rearward end of the loop than to the forward end thereof. The stand holds the device upright and provides additional surface area and stability to the device when in use on a wet or slippery surface.

DETAILED DESCRIPTION OF THE PREFERRED EMBODIMENT

Figure 1:
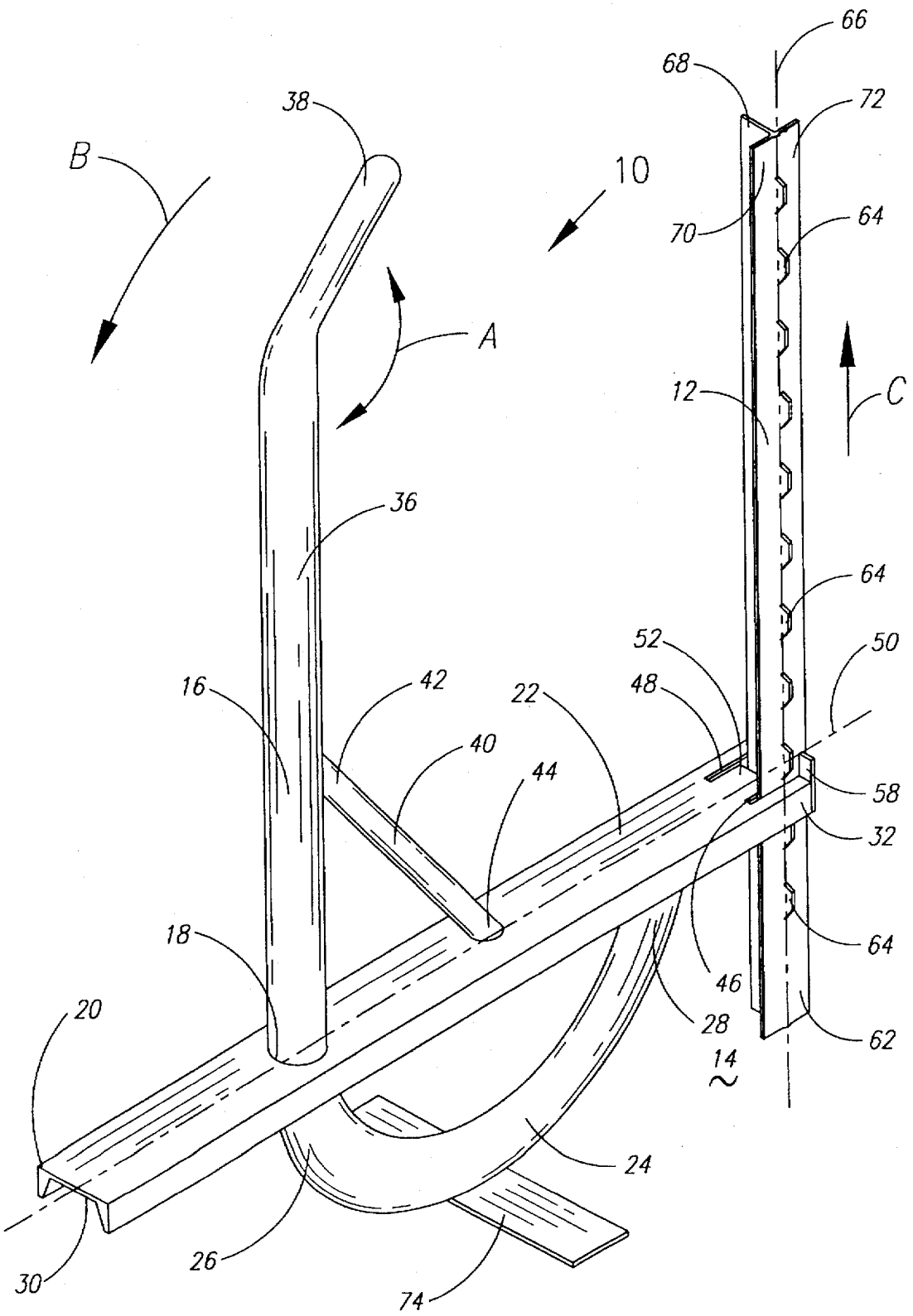
FIG. 1 is a perspective view of a device for pulling fence posts constructed according to a preferred embodiment of the present invention.

Referring now to the drawings and initially to FIG. 1, there is illustrated a device 10 for pulling T-type fence posts 12 out of a surface 14 of the ground into which the posts 12 were previously driven or otherwise installed.

The device 10 is comprised of a rod 16 which inserts through a rod opening 18 provided near a rear end 20 of a channel iron member 22. The rod 16 is curved to form a loop 24 below the member 22 with a rearward end 26 of the loop 24 located at the rod opening 18 and a forward end 28 of the loop 24 attaching, preferably by welding, to an underside 30 of the member 22 near a front end 32 of the member 22.

The member 22 has a flat upper side 34 and the rear end 20 of the member 22 extends beyond the rod 16. The rod 16 is provided with an upper rod end 36 which extends upward from the member 22 several feet and serves as a means for the user to grip the device 10 in order to use it, as will be explained more fully hereafter. A terminal portion 38 of the upper rod end 36 is preferably bent slightly toward the front end 32 of the member 22, so that the terminal portion 38 forms an angle "A" of approximately 170 degrees with the upper rod end 36. This angle "A" makes the terminal portion 38 easier to grip and allows the user to place one of his feet on the upper side 34 of the rear end 20 of the member 22 and to lean toward the rod 16 when using the device 10.

The rod 16 is secured within the opening 18, preferably by means of welding or other similar means, and a support bar 40 secures by an upper end 42 to the upper rod end 36 and by an opposite lower end 44 to the upper side 34 of member 22 at a point between the opening 18 and the front end 32. The support bar 40 strengthens the rod 16 so that it does not bend as the user exerts a rearward pulling force on it, as will be explained more fully hereafter.

Figure 3:
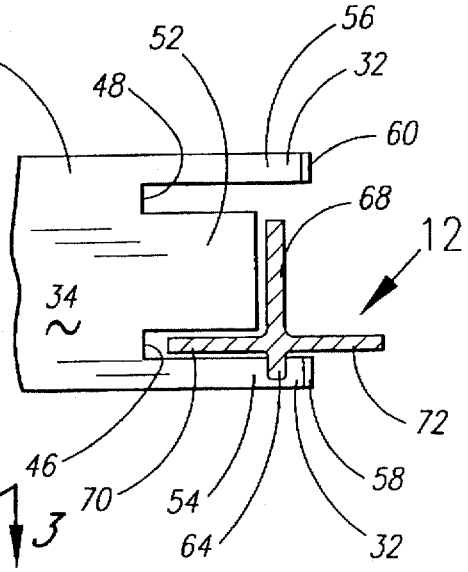
FIG. 3 is a cross-sectional view taken along line 3—3 of FIG. 2.

The front end 32 of the member 22 is provided with first and second slots 46 and 48 which are parallel with each other and also parallel with a longitudinal axis 50 of the member 22. The first and second slots 46 and 48 are separated from each other by a tongue 52 which extends forward toward the front end 32 of member 22 but terminates rearward thereof, as best seen in FIG. 3. The member 22 is provided with a first arm 54 and a second arm 56 both extending forward on the front end 32 so that the first slot 46 is located between the tongue 52 and the first arm 54 and so that the second slot 48 is located between the tongue 52 and the second arm 56.

Each arm 54 and 56 is provided terminally with an upwardly extending tab, 58 and 60 respectively, so that the tabs 58 and 60 extend upward slightly beyond the upper side 32 of the member 22.

Figure 2:
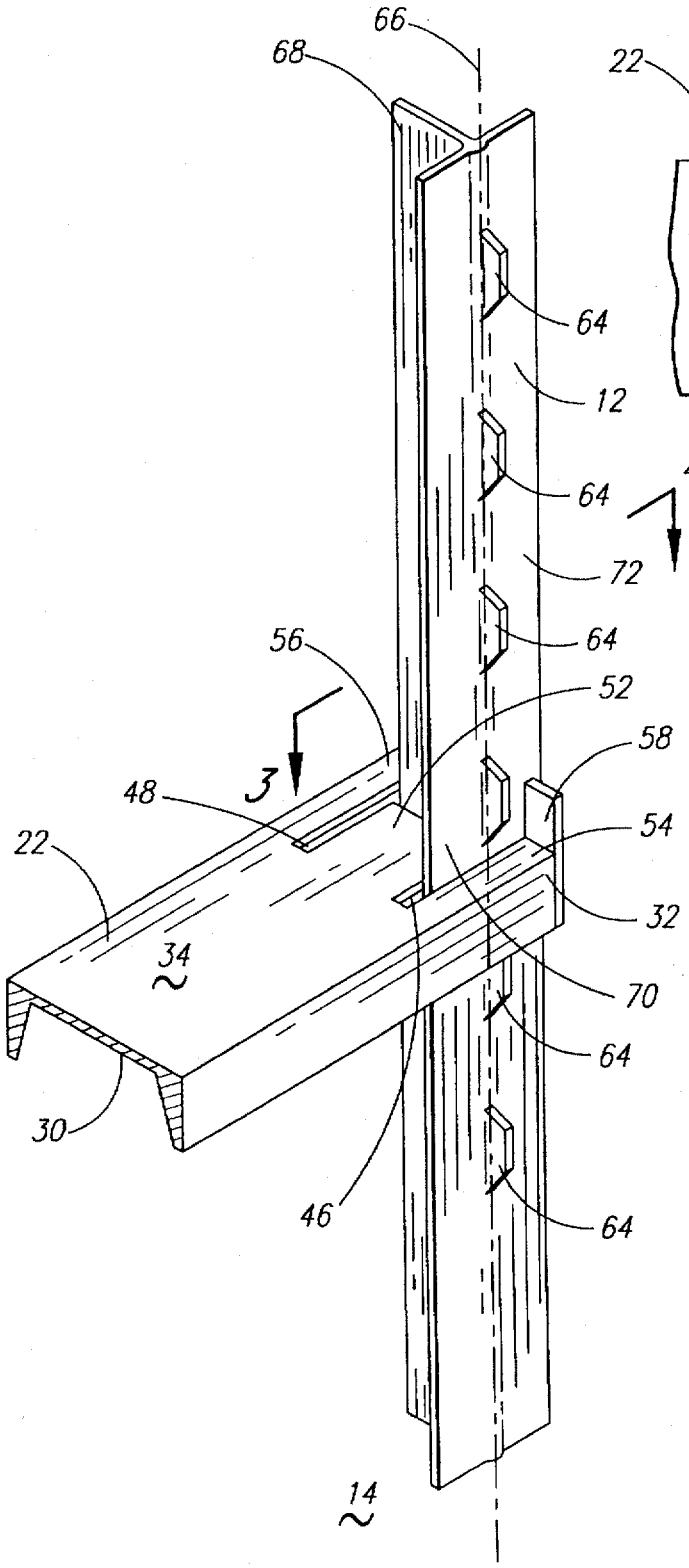
FIG. 2 is an enlarged view of the right-hand portion of FIG. 1 showing the device attached to a T-type fence post.

The function of the slots 46 and 48, the tongue 52, the arms 54 and 56 and the tabs 58 and 60 are illustrated in FIGS. 2 and 3. The T-type fence post 12 normally has a flat back bar 62 which is provided with a plurality of spaced apart ears 64 extending outward from one side of the flat back bar 62, with the ears 64 arranged in single file along a longitudinal axis 66 of the post 12. As seen in cross section in FIG. 3, each of the T-type posts 12 is provided with a lower bar 68 which attaches to an opposite side of the flat back bar 62 along the longitudinal axis 66, thus separating the flat back bar 62 into a left half 70 and a right half 72. In order to use the device 10, the front end 32 is moved toward either the left or right half, 70 or 72, of the post 12 until the tab, either 58 or 60, passes between and beyond adjacent ears 64 on the post 12 and the half, either 70 or 72, enters the slot, either 46 or 48, depending on which side of the post 12 the device 10 is positioned.

Figure 4:
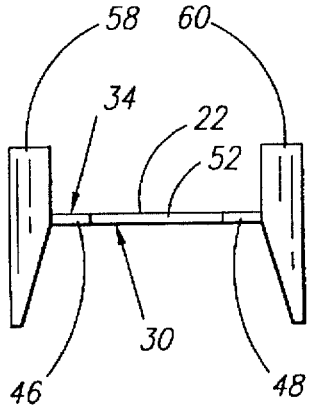
FIG. 4 is a front elevation of the device of FIG. 2 as the device would appear with the post removed.

Referring now to FIG. 4, a lower end of an inner portion of each of the tabs 58 and 60 tapers outward so the tabs 58 and 60 coincide with lateral downwardly oriented portions of the channel member 22 to which the tabs 58 and 60 are welded. By being tapered, the tabs 58 and 60 are more easily inserted and removed from between adjacent ears 64 of the posts 12.

Once the device 10 is thus positioned relative to the post 12, the front end 32 is raised slightly so that the tab, either 58 or 60, is located relative to the ear 64 which is located directly above the member 22 on a side of the ear 64 opposite the device 10.

As shown in FIGS. 2 and 3, the tab, either 58 or 60, holds the post 12 in close association with the device 10 so that the half, either 70 or 72, is fully inserted into the slot, either 46 or 48, and the lower bar 68 is positioned adjacent the tongue 52. The arms 54 and 56 are spaced apart a distance just sufficient to allow the lower bar 68 of the post 12 to enter therebetween, as illustrated in FIG. 3. This close association of the device 10 with the post 12 prevents the post 12 from twisting within the device 10 and possibly becoming disengaged therefrom as the device 10 is employed to remove the post 12 from the surface 14 of the ground.

At this point, with the loop 24 resting on the surface 14 of the ground, the user exerts a backward pulling force on the upper rod 36 or on the terminal portion 38 thereof, as shown by arrow B of FIG. 1. This forces the front end 32 to move upward, as illustrated by arrow C in FIG. 1, pulling the attached post 12 upward with it. In order to provide stability to the device 10, a stand 74 may optionally be attached to a bottom surface of the loop 24, preferably slightly closer to the rearward end 26 than to the forward end 28. The stand 74 will serve to hold the device 10 in an upright position, both when the device 10 is attached to a post 12 and when it is freestanding. The stand 74 also will help to prevent the loop 24 from being mashed into the surface 14 of the ground when the ground is soft from rain or moisture.

The user may place one of his feet on the upper side 34 of the member 22 between the rod 16 and the rear end 20 in order to provide more force on the device 10. Downward pressure from the user's foot is translated into an upward force on the front end 32 where the post 12 is attached to the device 10.

For a post 12 which has been driven so far into the surface 14 of the ground that it cannot be pulled out by engaging the post 12 with the device 10 a single time, the device 10 can be used repeatedly to pull the post 12 upward by removing and reattaching the device 10 to another ear 64 located at a lower point on the post 12 from the ear 64 previously engaged.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device for pulling posts out of the ground comprising:

a horizontal member being provided with a fastening means provided on a front end of said horizontal member for removably engaging a post, said horizontal member being provided with an opposite rear end onto which a user may place his foot, a rod extending upward from said horizontal member adjacent said rear end for the user to grip with his hands, a loop extending downward from said horizontal member and attaching to said horizontal member adjacent said front and rear ends, and said fastening means further comprising said front end being provided with a central tongue, a slot being provided on either side of said tongue so that both said slots are parallel with a longitudinal axis of said horizontal member, arms parallel with said slots being provided adjacent said slots, an upwardly extending tab being provided terminally on each arm and said tongue terminating rearward of said front end.

2. A device according to claim 1 further comprising a stand attaching to a lower portion of said loop.

3. A device according to claim 2 to a rearward end of said loop than to a forward end of said loop.

4. A device according to claim 3 wherein said stand is a flat piece of metal.

5. A device for moving objects upward relative to the ground comprising:

a loop provided on a lower surface of a member for holding said member off the ground and for serving as a fulcrum on which said member pivots, a rod extending upward from said member and attaching to said member adjacent a rear end of said member, means for removably fastening a front end of said member to an object to be moved upward relative to the ground, and at least one arm and an adjacent slot being provided on said front end, an upwardly extending tab being provided on said arm so that said tab inserts between ears provided on a T-type post and said slot receives a half of said post.

6. A device according to claim 5 futher comprising:

a stand provided on a lower portion of said loop.

7. A device according to claim 6 further comprising a support rod attaching by one end to said rod and attaching by an opposite end to said member.

8. A device according to claim 7 further comprising:

a terminal end provided uppermost on said rod, said terminal end extending slightly forward so that it forms an angle of less than 180 degrees with said rod.

* * * * *